US006367467B1

(12) United States Patent
McGregor et al.

(10) Patent No.: US 6,367,467 B1
(45) Date of Patent: Apr. 9, 2002

(54) HOLDING UNIT FOR SEMICONDUCTOR WAFER SAWING

(75) Inventors: A. Dempsey McGregor, Mena, AR (US); Marshall P. Toombs; James E. Brooks, both of Spotsylvania, VA (US); Benjamin J. Meadows, Fredb., VA (US)

(73) Assignee: Virginia Semiconductor, Fredericksburg, VA (US)

( * ) Notice: Subject to any disclaimer, the term of this patent is extended or adjusted under 35 U.S.C. 154(b) by 0 days.

(21) Appl. No.: 09/336,306

(22) Filed: Jun. 18, 1999

(51) Int. Cl.[7] ..... B28D 1/02

(52) U.S. Cl. ..... 125/35; 125/13.02; 125/16.02; 125/28; 451/41

(58) Field of Search ..... 125/35, 13.02, 125/16.02, 28; 451/460; 269/286; 83/651.1

(56) References Cited

U.S. PATENT DOCUMENTS 4,227,348 A * 10/1980 Demers et al. ..... 451/41
4,819,387 A * 4/1989 Harbarger ..... 451/41
5,123,636 A * 6/1992 Dumler et al. ..... 269/286
5,316,586 A * 5/1994 Hoenk et al. ..... 269/286
5,799,644 A * 9/1998 Nishida ..... 125/35
5,875,769 A * 3/1999 Toyama et al. ..... 125/16.01
6,006,736 A * 12/1999 Suzuki et al. ..... 125/13.02

FOREIGN PATENT DOCUMENTS

DE 2752-925 * 5/1979 ..... 125/35

OTHER PUBLICATIONS

Dyer, L.D., "Recent Advances in Substrate Sawing Technology." Industrial Diamond Review, pp. 74–76.

* cited by examiner

*Primary Examiner*—G Nguyen
(74) *Attorney, Agent, or Firm*—Fish & Richardson P.C.

(57) ABSTRACT

A holding unit is provided to support an ingot in a semiconductor wafer sawing machine, which minimizes the instability of a blade during a sawing process. The holding unit is formed from substantially the same material as an ingot resting thereon. The holding unit includes a top surface for receiving an ingot, a bottom surface, a pair of side walls, and a cavity formed in the holding unit. The cavity forms a plurality of break points in the holding unit. When contacted by the blade, the holding unit fractures at the break points to minimize the chipping of the wafer.

23 Claims, 3 Drawing Sheets

HOLDING UNIT FOR SEMICONDUCTOR WAFER SAWING

BACKGROUND OF THE INVENTION

The present invention generally relates to an apparatus for use in semiconductor wafer sawing, and more particularly to a holding unit for supporting a crystal ingot during a sawing process.

In semiconductor manufacturing, wafers are generally formed from grown crystal ingots. An ingot is a crystal formation grown from a seed in a melt under suitable temperature and pressure conditions. After suitable growth occurs on the seed, the resulting ingot is pulled-up in a conventional pulling apparatus from the melt. Next, a wafer may be sliced from the ingot using a cutting apparatus such as a saw.

Generally, an internal diameter saw includes an annular blade which has an inner edge coated with a hard material such as diamond powder or grit. Typically, the blade is rotated at a high speed as the ingot is advanced toward the blade. Alternatively, the inner edge of the blade may be moved through a stationary ingot. The inner edge of the blade contacts the ingot in a direction normal to the axis of the ingot to cut therethrough.

In many instances, a holding unit is attached to a lower side of the ingot to support the ingot during the sawing process. One such process is plunge mode. In this process, the saw is advanced completely through the ingot and the holding unit to form a wafer. The saw blade is then retracted to its initial position for the next saw cut.

In another sawing process, the saw may be advanced through the ingot, but only partially through the holding unit. This process may be repeated to yield a group of wafers that are manually separated from the holding unit.

When the holding unit is formed from a material which is different from the crystal ingot, the material from the ingot can tend to chip. The chipping of the ingot causes an increase in labor and material costs as well as a loss in yield.

For example, when the holding unit is formed from a more fragile material than the ingot, the saw cutting into the holding unit induces blade vibration. As a result, the contact pressure surrounding the blade is unstable which leads to chipping. The blade is also able to move laterally in the softer material. This tends to increase the stress on the material during its withdrawal from the ingot, and thus, increases the amount of chipping of the resulting wafer.

Another disadvantage in known sawing systems is that the saw blade tends to lose its shape because of the variance in materials of the ingot and holding unit. A densified powder layer may also form on the blade. As a result, the blade may be dulled. The resulting sliced wafer may be warped or bow in one direction.

SUMMARY OF THE INVENTION

In general, the present invention is directed towards a holding unit for supporting an ingot in a semiconductor wafer sawing machine. The holding unit is formed from substantially the same material as the ingot and includes a plurality of break points.

Accordingly, in one aspect, the invention is directed to a holding unit for use in a semiconductor ingot sawing machine that includes a top surface and a bottom surface. The top surface includes holding surfaces to secure an ingot of semiconductor material. First and second legs may extend from the bottom surface, and a cavity may be formed from the first and second legs and the bottom surface to form a plurality of break points in the holding unit. The holding unit and the ingot may be formed from substantially the same material.

Implementations of the invention include one or more of the following. An end of each of the first and second legs may be tapered. The holding unit and the ingot may be formed from silicon. The sawing machine may include a slide unit to move the holding unit with the ingot mounted thereto to a first position. An arm may be used to move a blade in a direction normal to the ingot when the ingot is in the first position. The blade may slice through the ingot and at least a portion of the mounting strip to form a wafer. The blade may be an internal diameter sawing blade.

In accordance with another aspect, the invention is directed to a holding unit for a semiconductor wafer sawing machine that includes a top surface and a bottom surface. The top surface may have a shape suitable to secure an ingot. The holding unit may also include a first and second cavity, and a plurality of break points may be formed from the cavities. The ingot and the holding unit may be formed from substantially the same material.

DETAILED DESCRIPTION

Figure 1:
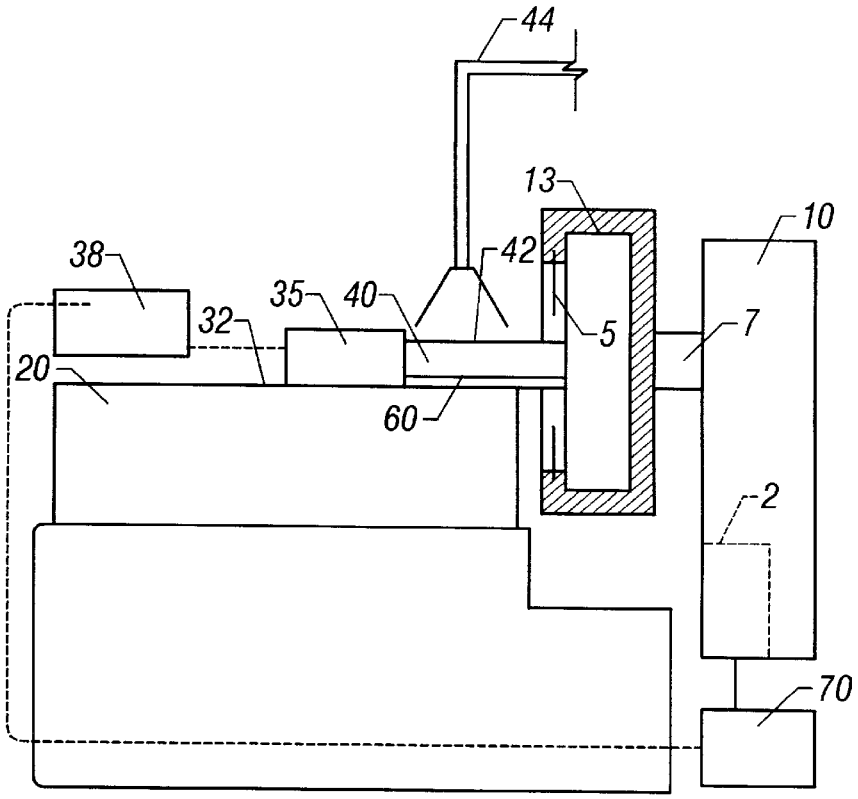
FIG. 1 illustrates an exemplary semiconductor wafer sawing apparatus.
Figure 2:
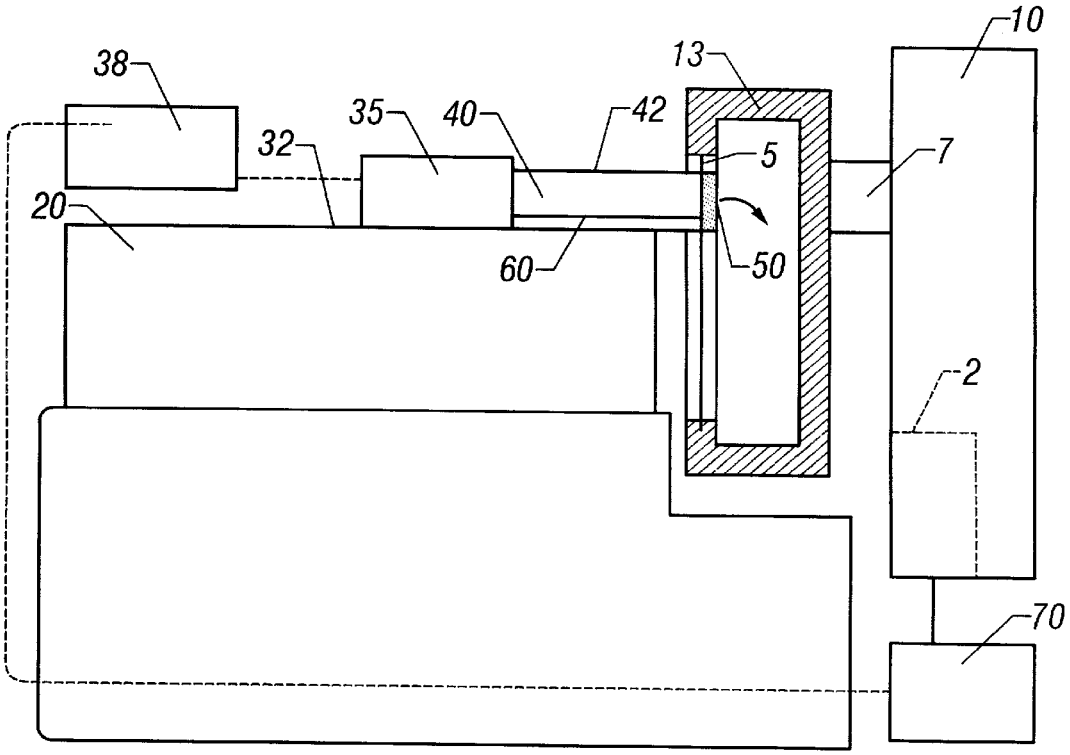
FIG. 2 illustrates a wafer being formed by the sawing apparatus of FIG. 1.

FIG. 1 illustrates an exemplary sawing machine 1. The sawing machine 1 may be an internal diameter (ID) sawing machine which forms individual wafers 50 (FIG. 2), as discussed below. Alternatively, a multiple wire machine that forms a plurality of wafers simultaneously may be employed. The sawing machine 1 generally includes a spindle head 7 electrically connected to an output of a motor 2 and to a movable load arm 10. The load arm 10 may be electrically coupled to a controller to move the spindle head and a blade 5 a predetermined distance to form a plurality of wafers 50 (FIG. 2).

The sawing machine 1 also includes the blade 5 which is rotatably affixed to the spindle head 7 through a blade-mounting drum 13. The blade 5 is mounted and stretched by the drum 13 to increase the rigidity of blade 5. During the operation of sawing machine 1, the motor 2 is driven to rotate the spindle head 7 and the blade 5 in a counter clockwise or clockwise direction at a suitable speed to slice through an ingot 40 and a holding unit 60, as discussed below. The motor 2 may be a servomotor or other suitable motor to rotate the spindle head 7 and the blade 5.

Figure 1A:
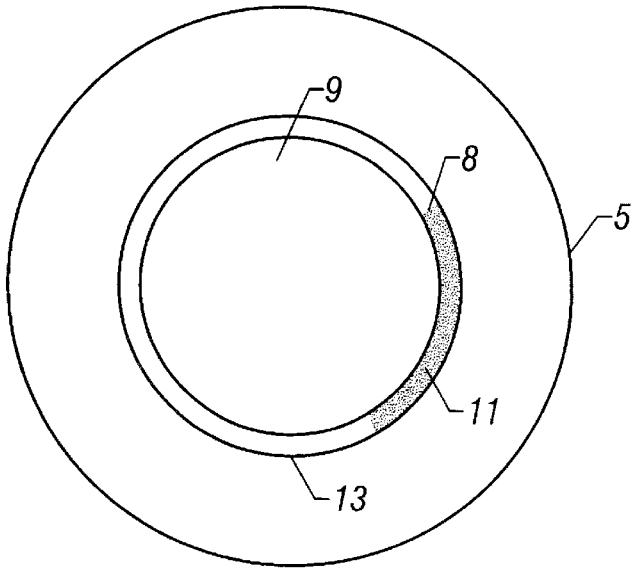
FIG. 1A illustrates a sawing blade of the semiconductor wafer sawing apparatus of FIG. 1.

FIG. 1A illustrates an example of a suitable blade 5 which includes a cutting surface 8. Cutting surface 8 is formed near the center of blade 5 and includes a coating 11. Coating 11 is formed from an abrasive material such as diamond, and may cover at least a portion of cutting surface 8. Coating 11 may be secured to cutting surface 8 by a matrix 13 formed from nickel or other suitable material. Further details of blade 5 may be found in U.S. Pat. No. 4,498,345, issued Feb. 12, 1985.

The sawing machine 1 also includes a slide unit 20, which includes a top surface 32 and a feeder 35 slidably coupled to the top surface 32. A motor 38, such as a stepper motor, is electrically connected to the feeder 35 to displace the feeder 35 across the top surface 32 toward the blade 5 during the sawing process. The slide unit 20 may also form the base of the sawing machine 1. A controller 70 may be electrically connected to the motors 2 and 38 to control the movement of spindle head 7 and the feeder 35, respectively.

The sawing machine 1 may also include a plurality of nozzles (not shown) connected to the load arm 10 to wash and recondition the blade 5. A wafer holder (not shown) may also be positioned under the blade to receive wafers 50 after the slicing operation. Additionally, a fluid pan (not shown) may be connected to the slider unit 20 to move under the blade to receive excess fluid from washing or reconditioning the blade 5.

FIG. 1 illustrates the ingot 40 and the holding unit 60 disposed on the top surface 32 adjacent to feeder 35. The holding unit 60 is mounted to the ingot 40 such that a wafer 50 may be separated from the ingot 40 by the blade 5 after the sawing process. The ingot 40 may be mounted to holding unit 60 by an adhesive such as glue. The ingot 40 is deposited on slide unit 20 manually or by a load arm 44. The ingot 40 may be formed from a material suitable for semiconductor fabrication. Suitable materials include silicon, gallium arsenide, silicon-germanium, germanium, lithium niobate, indium and antimonide, and gadolinium-gallium garnet.

In the preferred sawing process, the ingot 40 is moved by the feeder 35 across the top surface 32 such that a portion of the ingot 40 to be cut projects into an area 9 defined by cutting surface 8. At this stage, the blade 5 is in an initial cutting position. The amount by which ingot 40 projects into an area 9 defined by the cutting surface 8 is a function of the thickness of the wafer 50 to be formed and the kerf thickness of the blade. The term "kerf" may be defined as the width of a cut made by blade 5. The area 9 is substantially larger than the ingot 40 to be sliced. The load arm 10 is then displaced downward to cause blade 5 to cut through the ingot and through the holding unit, as described below. The wafers 50 may have a thickness of about 0.005 inches or more.

Referring now to FIG. 2, the load arm 10 guides the blade 5 through the ingot 40 and a portion of holding unit 60 until a wafer 50 is formed. The cutting surface 8 of blade 5 slices the ingot 40 and holding unit 60 in a direction normal to the top surface of the ingot 40. After the wafer 50 is formed, the load arm 10 moves the blade 5 to its initial cutting position. For the next blade cut, the ingot 40 is again advanced by feeder 35 into area 9. The cutting surface 8 is then urged through the ingot 40 and a portion of holding unit 60 to form another wafer 50. The wafer may then be removed from the holding unit 60 manually or mechanically. It should be noted that blade 5 may cut through a portion or the entirety of holding unit 60.

In another processing regime, a plurality of cutting-type wires may be advanced through the entire length of the ingot to form a plurality of wafers in one saw cut. The plurality of wires may be spaced apart by a distance about equal to the thickness of the desired wafers 50 plus the kerf thickness. In this case, the feeder 35 is not required.

As discussed above, in known manufacturing methods, when the blade 5 contacts the ingot 40 and the holding unit 60, the resulting wafers often chip (FIG. 2). The chipping may add labor and material costs to the manufacturing process. This results partially due to the instability imposed on the blade when it slices through the varying materials between the holding unit and the ingot.

It has been found that forming the holding unit 60 from substantially the same material as the ingot 40 minimizes the chipping of the resulting wafers 50. For example, the ingot 40 and the holding unit 60 may be formed from silicon. In one embodiment, the holding unit 60 is formed from scrap ingots. Alternatively, the holding unit 60 may be formed from a bar of silicon into a desired shape. The material of the holding unit 60 may include dislocations or polycrystalline material.

Figure 3:
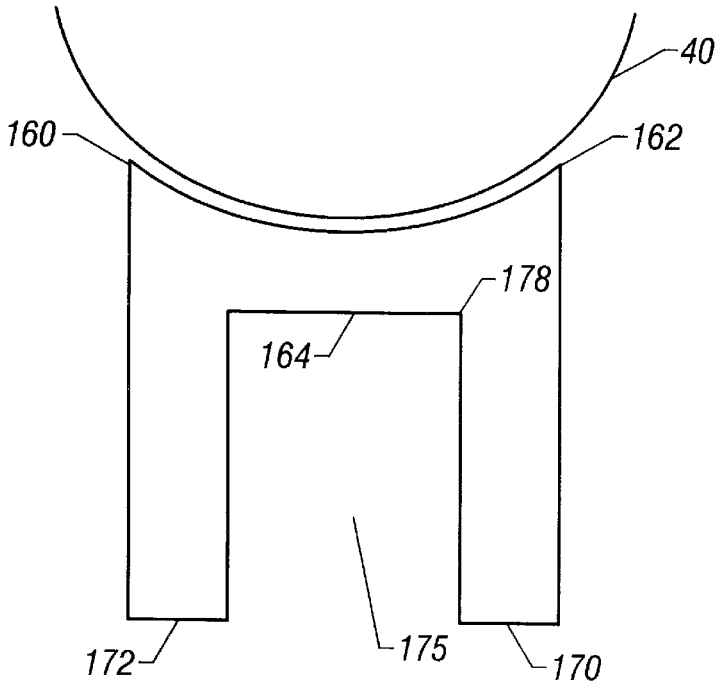
FIG. 3 illustrates a cross-sectional view of an ingot resting on a holding unit in accordance with one embodiment.

FIG. 3 illustrates a cross-section of a first embodiment of a holding unit 160. The holding unit 160 includes a top surface 162, a bottom surface 164, and legs 170 and 172. The legs 170 and 172 may be tapered. As shown in FIG. 3, the top surface 162 is designed to correspond to the bottom surface of the ingot 40.

The legs 170 and 172 and bottom surface 164 form a cavity 175 through the holding unit 160. The cavity 175 may be formed by etching, milling, sawing, grinding or other suitable methods. The cavity forms a plurality of break points 178 in the holding unit 160. In this configuration, the holding unit 160 fractures at the break point 178, and the wafer 50 separates from the ingot 40 when the blade enters the cavity 175. It should be noted that break points 178 are designed to be the weakest portion of holding unit 160.

Figure 4:
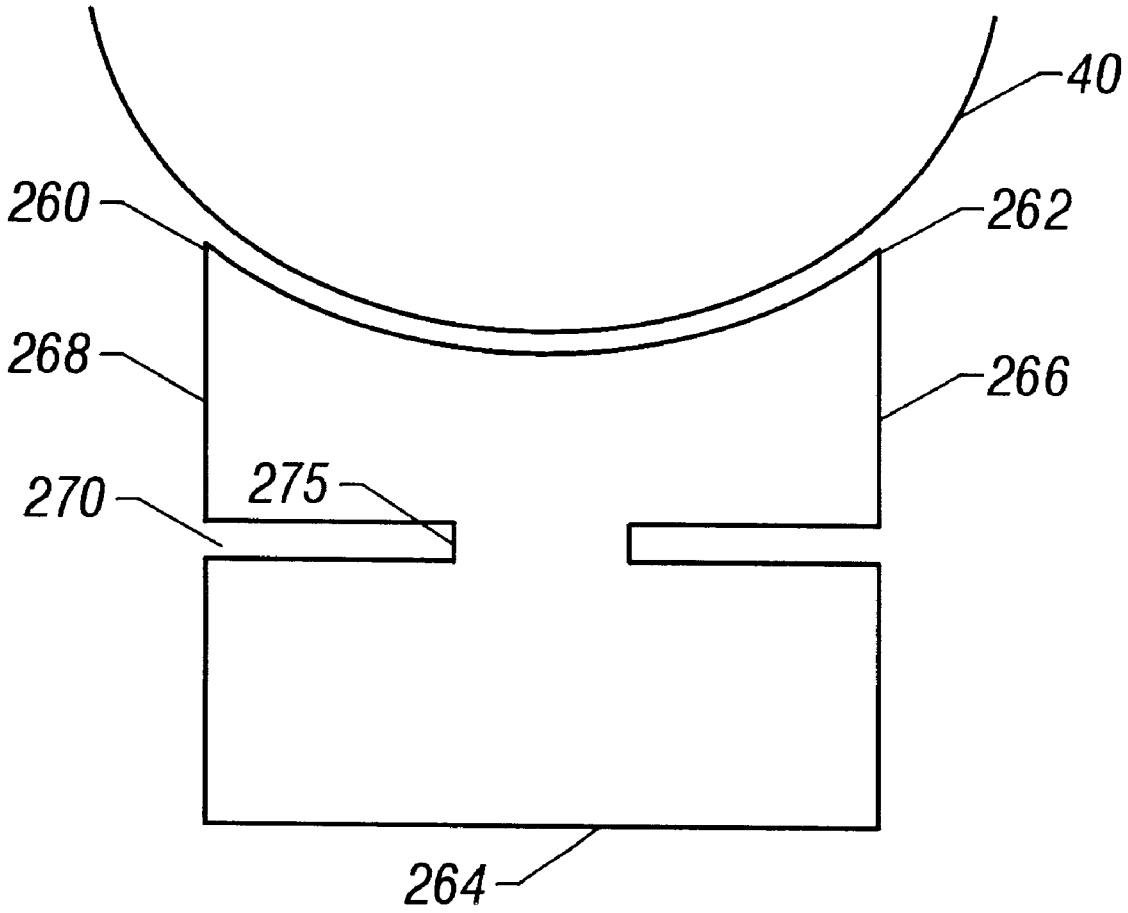
FIG. 4 illustrates a cross-sectional view of a holding unit in accordance with a second embodiment.

FIG. 4 shows a cross-sectional view of a second embodiment of the holding unit. The holding unit 260 includes a top surface 262, a bottom surface 264, and side walls 266 and 268. The top surface 262 is designed to correspond to the bottom surface of the ingot 40.

Cavities 270 are formed in the side walls 266 and 268, and extend along the length of the holding unit 260 to create a plurality of break points 275. The cavities 270 may be formed by etching, sawing, shearing, or other suitable techniques. When the blade 5 slices through the holding unit 260, the holding unit 260 fractures at the break point 275, and the wafer 50 separates from the ingot 40. It should be noted that break points 275 are designed to be the weakest point of holding unit 260.

Cavities 175 and 270 are not required in a plunge mode cutting process, that is, one where the blade 5 is advanced completely through the ingot 40 and the holding unit. These cavities also might not be necessary when a multiple wire machine is employed. In these cases, the formation of the holding unit from the same material as the ingot may be sufficient to minimize the chipping of the wafers.

The present invention has been described in terms of number of embodiments. The invention, however, is not limited to the embodiments depicted and described. For example, variations in the material of the holding unit and the ingot as well as the size and shape of the cavities may be altered to further reduce the chipping of the resulting wafer during processing.

What is claimed is:

1. A holding unit, comprising:

a top surface and a bottom surface, the top surface having a shape suitable to secure an ingot;

a first side wall and a second side wall;

a first cavity formed in the first side wall, and a second cavity formed in the second side wall; and a plurality of break points formed from the first and second cavities, the ingot and the holding unit being formed from substantially the same material.

2. The holding unit of claim 1, wherein the material comprises silicon.

3. The holding unit of claim 1, wherein the holding unit fractures at selected ones of the plurality of break points when contacted by a blade.

4. An apparatus, comprising:

a holding unit to hold an ingot, the holding unit including a plurality of break points and the holding unit and the ingot being formed from substantially the same material and the holding unit including a first and second side walls each having a cavity, the holding unit being fractured at at least one of the plurality of break points when a blade contacts the at least one break point.

5. The apparatus of claim 4, wherein the material comprises silicon.

6. The apparatus of claim 4, wherein the holding unit further comprises a top surface shaped to hold the ingot.

7. The apparatus of claim 4, wherein each of the plurality of break points are formed from at least one cavity formed from the holding unit.

8. The apparatus of claim 4, wherein the material comprises one of dislocations and polycrystalline material.

9. The apparatus of claim 4, wherein the holding unit comprises at least one scrap ingot.

10. The apparatus of claim 4, wherein the material comprises one of gallium arsenide, silicon-germanium, germanium, lithium niobate, indium, antimonide, and gadolinium-gallium garnet.

11. An apparatus, comprising:

a top surface shaped to hold an ingot; and first and second side walls each having a cavity, the apparatus and the ingot being formed from substantially the same material.

12. The apparatus of claim 11, wherein the material comprises silicon.

13. The apparatus of claim 11, wherein each cavity forms a plurality of break points, the break points fracturing when contacted by a blade.

14. The apparatus of claim 11, wherein the material comprises one of gallium arsenide, silicon-germanium, germanium, lithium niobate, indium, antimonide, and gadalinium-gallium garnet.

15. The machine of claim 14, wherein the blade comprises one of an internal diameter saw blade and a plurality of cutting wires.

16. The machine of claim 14 further comprising a plurality of nozzles connected to the arm.

17. The apparatus of claim 11, wherein the material comprises one of gallium arsenide, silicon-germanium, germanium, lithium niobate, indium, antimonide, and gadolinium-gallium garnet.

18. The apparatus of claim 11, wherein the material comprises one of dislocations and polycrystalline material.

19. A sawing machine, comprising:

a holding unit having an ingot of semiconductor material disposed thereon, the holding unit and the ingot being formed from substantially the same material, and the holding unit having first and second side walls each having a cavity;

a slide unit, the slide unit being operable to move said holding unit to a first sawing position;

an arm fixed relative to the slide unit;

a motor electrically coupled to the arm; and a blade electrically connected to the motor to rotate the blade, the blade slicing through the ingot and a plurality of break points in the holding unit in the first sawing position to form a plurality of wafers.

20. The apparatus of claim 19, wherein the holding unit further comprises a top surface shaped to hold the ingot.

21. The apparatus of claim 19, wherein the material comprises one of dislocations and polycrystalline material.

22. The apparatus of claim 19, wherein the holding unit comprises at least one scrap ingot.

23. The apparatus of claim 19, wherein the material comprises one of gallium arsenide, silicon-germanium, germanium, lithium niobate, indium, antimonide, and gadolinium-gallium garnet.

* * * * *